US005785228A

United States Patent [19]

Fa et al.

[11] Patent Number: 5,785,228

[45] Date of Patent: Jul. 28, 1998

[54] DUAL MODE PNEUMATIC TOOL

[75] Inventors: Chen Chiu Fa, Ta Li; Yang Chun Hsien, Chia Yi, both of Taiwan

[73] Assignee: Campbell Hausfeld/Scott Fetzer Company, Harrison, Ohio

[21] Appl. No.: 895,311

[22] Filed: Jul. 16, 1997

Related U.S. Application Data

[62] Division of Ser. No. 509,023, Jul. 28, 1995, Pat. No. 5,687,897.

[51] Int. Cl.[6] ..... B25C 1/04

[52] U.S. Cl. ..... 227/8; 227/130

[58] Field of Search ..... 227/8, 130

[56] References Cited

U.S. PATENT DOCUMENTS

| | | | |
|---|---|---|---|
| 4,264,028 | 4/1981 | Austin | 227/8 |
| 4,629,106 | 12/1986 | Howard et al. | 227/8 |
| 5,083,694 | 1/1992 | Lemos | 227/8 |
| 5,137,197 | 8/1992 | Bauer | 227/8 |
| 5,522,532 | 6/1996 | Chen | 227/8 |
| 5,551,620 | 9/1996 | Vallee | 227/8 |
| 5,597,106 | 1/1997 | Hamano et al. | 227/8 |
| 5,669,541 | 9/1997 | Ronconi | 227/130 |
| 5,692,663 | 12/1997 | Yang | 227/8 |

*Primary Examiner*—Scott A. Smith
*Attorney, Agent, or Firm*—Jones, Day, Reavis & Pogue

[57] ABSTRACT

A single cycle/multiple cycle dual mode pneumatically driven fastener driving tool utilizes a resettable valve, trigger apparatus, work contact element (WCE) and a mode selecting trigger blocking pin. With the pin in place, the trigger must be released then depressed for each tool actuation. The tool is actuated only when the WCE is also depressed but without regard to the sequence of trigger and WCE depression. In a multiple cycle mode, the pin is removed and the actuation valve is reset either by trigger extension, or by WCE extension for "bottom contact" operation. The tool can be activated by full trigger release and depression while the WCE is held against a work surface. No particular sequence of WCE and trigger depression is required in this second mode. Apparatus and methods are disclosed.

2 Claims, 9 Drawing Sheets

FIG. 7

DUAL MODE PNEUMATIC TOOL

This application is a divisional, of application Ser. No. 08/509,023, filed Jul. 28, 1995, now U.S. Pat. No. 5,687,897.

BACKGROUND OF THE INVENTION

This invention relates to the operation of pneumatically powered tools, such as pneumatic staplers and nailers, and more particularly to apparatus for actuating pneumatically powered tools in multiple modes of operation.

Pneumatically powered tools such as nailers and staplers typically have a pneumatically driven piston for driving a fastener, a firing valve or head valve for controlling the action of compressed air over the piston, a trigger valve for controlling the firing valve, a trigger for actuating the trigger valve, and a work contacting element or "WCE" interacting with the trigger and the tool. Generally, the tools will not operate unless the WCE is engaged against a work surface and the tool pushed toward the surface to depress the WCE into a position permitting tool actuation by a trigger mechanism controlled in part by the WCE. Various configurations of these elements are well known in the field.

These tools in the past were activated in a number of varied modes. For example, in a "sequential" mode, the WCE must first be pushed against a work surface before movement of the trigger will actuate the trigger valve to operate the tool. If the WCE is not first pushed in, the tool will not operate when the trigger only is pulled, even if the WCE is depressed later; thus the name "sequential" for such an apparatus.

In another mode of operation, known as the "bottom contact" mode, the trigger is depressed and held in the depressed condition. The tool actuates to drive a fastener every time the WCE is pushed against a surface. Thus as the bottom end of the WCE contacts a surface and is moved rearwardly, its upper or distal end interacts with a mechanism to activate the tool and drive a fastener.

It is now desirable to provide a pneumatic tool capable of operating in different modes. Specifically, it is desirable to provide a tool having a single cycle operation which requires the trigger to be released and pulled for each actuation to drive a fastener, whether or not the WCE (and tool) is held against a surface between actuations. It is also desirable to be able to convert the tool so that it can be operated in a multiple cycle mode such as by repeated "bottom contact" of the WCE when the trigger is held in a depressed condition and not released between cycles.

It is thus desirable to provide a tool which can be activated repeatedly without withdrawing the tool (or its WCE) from a work surface by repeatedly depressing and releasing the trigger, and which can be converted to operate in a multiple cycle, including a "bottom contact" mode, neither the single or multiple cycle modes requiring sequential operation of first WCE movement and then trigger movement before the tool will actuate, but both modes requiring WCE movement (and tool engagement with a workpiece) before the tool can be activated.

In another aspect of the invention, it is desirable to provide such a pneumatic tool which is easily converted from one such operation or mode to the other.

Another aspect of the invention is the provision of a pneumatic fastener driving tool, wherein the second mode of operation also accommodates or includes the first mode. Once in the second mode, no tool conversion is necessary to repeatedly cycle the tool merely by repeatedly pulling the trigger as long as the WCE is depressed against a workpiece.

In yet another aspect of the invention, it is desirable to provide such a convertible tool, yet which requires application of a conversion tool or separate tool before the multiple cycle operational mode can be selected.

It is thus a further objection of the invention to provide a multiple operation or function tool which provides the convenience of repeated actuations by trigger pull when the tool is held against a surface or repeated "bottom contact" actuations when the trigger is held depressed, both without the necessity of "sequential" operation but both with the necessity of WCE actuation prior to tool actuation.

A further objective of the invention has been to provide a mode selector in a pneumatic fastener driving tool, for selecting different operations of the tool.

A further objective of the invention has been to provide an improved actuation valve and trigger apparatus for a dual mode pneumatic fastener driving tool.

A still further objective of the invention is to provide an improved method of operating a pneumatic fastener driving tool in dual modes of operation.

To these ends, the invention contemplates a two lever trigger apparatus, a resettable valve operable by the trigger, and a removable mode selecting trigger blocking element or pin for selecting a desired operating mode. A pneumatic fastener tool is provided with a trigger apparatus having a removable function selecting pin acting as a fulcrum for one end of a secondary trigger lever pivoted at its other end to the main trigger lever. When the removable pin is in place, the secondary trigger lever will not permit the trigger valve to reset unless the trigger is totally released for maximum reset motion, and even though the WCE is fully extended. The pin blocks the reset motion of the distal end of the secondary trigger lever, preventing full extension of the WCE in a direction away from the tool from relieving the secondary trigger lever to reset the trigger valve. Thus, in a first single cycle mode, the tool cannot be actuated until the trigger is fully released and the trigger valve is thus reset, regardless of action of the WCE.

When the pin is withdrawn, the secondary trigger lever permits reset of the actuation valve when either the WCE is fully extended or the trigger is fully released. The tool is then activated by depression of both the trigger and the WCE, in any order, permitting "bottom contact" operation, or multiple trigger pull actions when the tool is held against the work surface. Thus, the second mode of operation subsumes or includes the first mode and a "bottom contact" operation as well.

Thus pin removal provides both operations at the handler's choice, but without predetermined "sequential" manipulation. If the pin is in place, then only the first operational mode is available where the tool is actuated only by full trigger release and depression for each fastener driving cycle.

The pin is manually removable at the will of an operator, being held in place, for example, by an O-ring in a groove around the opposite end of a headed pin, or by any other suitable means. Alternately, the pin is constituted as a roll pin, and another separate tool is required to remove it to attain "bottom contact" actuation capability.

This invention thus provides the advantage of a multiple operational tool wherein in a first mode, the tool requires full trigger pull and release between actuations. And in a second mode, the tool can be either actuated by multiple trigger pulls when the WCE is continually depressed into surface contact, or actuated by contacting and pressing the WCE against the work surface when the trigger is held depressed. The tool is easily convertible or can be rendered difficult to convert.

The invention is realized then, in part, by the use of a resettable valve for actuating the tool, a trigger apparatus, and a removable mode selecting pin. The valve has a valve stem which operates the valve when pushed in by the second trigger lever. After actuation, the valve cannot again actuate until after the stem has been allowed to extend outwardly to a reset position. Accordingly, the resetting of the valve, as a function of the condition of the control components of the tool, including the trigger levers, WCE and removable pin, constitutes one aspect of the invention.

DESCRIPTION OF THE DRAWINGS

FIG. 7 illustrates a trigger apparatus and a trigger valve according to the invention in a "reset" position, ready for actuation to cause the tool to operate, as suggested in FIG. 1;

FIG. 8 is an illustration similar to FIG. 7 but showing the valve stem moved partially into the valve by full depression of the trigger but not enough to actuate the tool as suggested in FIG. 2A;

FIG. 9 is an illustration similar to FIG. 8 showing the trigger still fully depressed and also showing the WCE depressed, with the valve in an actuated condition by the valve stem being fully depressed and as suggested in FIG. 3;

FIG. 10 is an illustration similar to FIG. 9 but showing the trigger still fully depressed and the valve stem partially but not fully returned to its "reset", fully extended position as suggested in FIG. 5;

FIG. 11 is an illustration of a trigger apparatus and trigger valve but with no pin in place and the valve in a "reset" position, the trigger released but the work contacting element fully engaged with a surface and in an up position;

FIG. 12 is an illustration similar to FIG. 11 but showing the work contact element, trigger valve and trigger in fully actuated positions;

FIG. 13 is an illustration similar to FIG. 12 but showing the work contact element fully extended downwardly, not in contact with a surface, the trigger fully depressed, and the trigger valve in a reset position.

Figure 14:
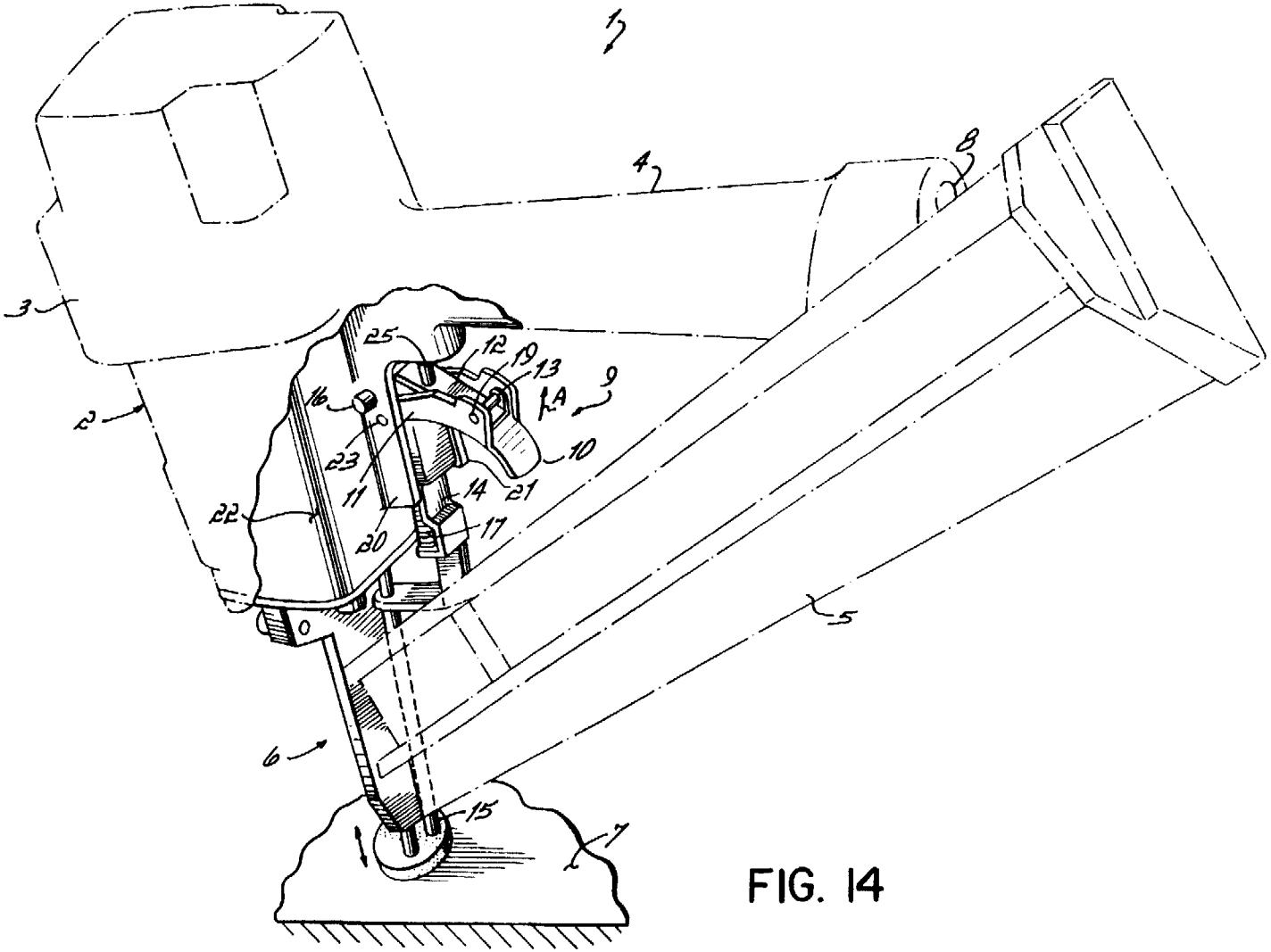
FIG. 14 is a perspective, view of a pneumatic tool according to the invention, with the trigger apparatus highlighted.

Turning now to the Figures, and particularly to FIG. 14, there is illustrated therein a pneumatic fastener driving tool 1 according to the invention, including a tool body 2, a tool head 3, a handle 4 and a magazine 5, all of typical or well known construction. It will be appreciated that FIG. 14 illustrates the tool 1 primarily in phantom, since the tool itself, apart from the detailed features of the invention as will be described herein, may take any conventional form and may use any number of conventional components, such as the tool body itself, the handle, the magazine, the drive station, and any pneumatic motor and firing or head valve not shown, as are well known in the industry.

The magazine 5 is particularly configured for housing a plurality of fasteners such as nails or staples, and delivering those fasteners one after the other to a driving station 6 where, upon actuation of the tool, a fastener is driven into a work surface 7. A line fitting 8 is usually supplied at the end of the hollow handle 4 for conveying line air pressure into the hollow handle 4 and into various pressurized chambers in the tool body 2 and/or the head 3 for operation of the tool, as will further be described.

A trigger apparatus 9 is illustrated in FIG. 14, the trigger having a first trigger lever 10 pivoted at its inner end 11 between two flanges 20, 21 of the tool housing 22 comprising part of the tool body 2. The first trigger lever 10 so described is pivotal about the pivot axis 23 for movement in the direction as indicated by the arrow A in FIG. 14. The trigger apparatus 9 also includes a secondary trigger lever 12 which is pivoted on axis 19 at one end thereof to the first trigger lever 10. Accordingly, as viewed in the horizontal presentation of FIG. 14, the pivot axis 23 of the lever 10 and the pivot axis 19 for the secondary lever 12 are spaced apart laterally.

Also, as shown in FIG. 14, is the upper or distal end of a work contacting element 14. As is illustrated in FIG. 14, the work contacting element, or WCE 14, constitutes the upper end of a multiple part WCE extending downwardly to a work contacting end 15, which is engageable with the work surface 7. When the tool 1 is pressed downwardly toward the work surface 7, the work contacting element 14, 15 is pressed or moved upwardly on the tool against the bias of the spring 17, so that the upper end 14 of the WCE is moved upwardly toward the trigger 9, as will be further described. When the tool 1 is lifted away from the surface 7, the lower work contacting end 15 is extensible and moves the upper end 14 of the WCE downwardly or in a direction away from the trigger 9 and its various components.

In addition, the tool 1 includes a valve 25 which is not shown in FIG. 14, but the details of which are shown throughout FIGS. 7–13. The valve 25 has an extensible stem or core 18 which is engageable by the secondary trigger lever 12, as will further be described in detail.

The tool 1, according to the invention, also includes a removable function selector pin 16. When the pin is in position, it extends through bores 27 (FIG. 11) in the flanges 20, 21 of the tool housing 22 so that the other end 24 (FIG. 7) of the secondary trigger lever 12 extends over the pin 16. Thus the pin, when in its first position, is operable to block off a certain lower portion of the downward motion of the end 24 of the secondary trigger lever 12, as will be further appreciated. When the pin 16 is removed for the second mode of operation, it will be appreciated that the secondary trigger lever 12 is not blocked and is operable to move through a greater distance or a greater angle than when the pin 16 is in place. This differential in the permitted motion of the secondary trigger lever 12 provides selection of the first mode or single cycle operation of the tool, and the second mode or multiple cycle operation of the tool, as will be described.

It will also be appreciated that the pin 16 is held within a bore 27 (see FIG. 11) through the flanges 20, 21 by means of an O-ring located on the pin 16. Thus the pin can be manually pressed into the bores in the position shown in the various figures and releasably held by the O-ring in this position. The removable O-ring renders the pin easily removable by simply pushing on the grooved end of the pin to remove it from bores 27.

In the alternative, it will be appreciated that the pin 16 may constitute some other form of blocking element or mechanism. For example, the pin 16 could take on the configuration of a simple roll pin which is driven into the holes in the flanges 20 and 21. In such a configuration, the pin 16 would place the tool in the first or single cycle mode of operation and the tool could only be utilized in the second or multiple cycle mode of operation if another tool was utilized to remove the roll pin from its position. This provides the capacity to make the selection of the various modes of operation of the tool more difficult and thus more easily limited by the owner or user of the tool, as may be desired.

Alternatively, any other blocking element or mechanism for the secondary trigger lever 12 may be used to the same end as described herein, and it will be appreciated that the utilization of a pin is only illustrative of a blocking element for the end 24 of the secondary trigger lever 12.

Having thus so described the general configuration of a pneumatic fastener driving tool 1 according to the invention, the details of the invention will now be further described. It will be appreciated that FIGS. 1 through 5 illustrate various positions of the trigger levers 10, 12, the WCE 14, the removable pin 16, the valve 25 and valve stem 18.

It will be appreciated that the valve 25, as will be further described, is a valve which after operating once requires a reset motion before the valve can be actuated in a subsequent cycle. That is to say that the valve stem or core 18 must be depressed to activate the valve and then must be extended a sufficient distance to reset the valve before the valve can again be actuated to actuate the tool to drive a fastener, all as explained in further detail below.

It will also be appreciated that the tool 1 is a dual mode pneumatic fastener driving tool which is operated in either a single cycle or first mode of operation, and in a multiple cycle or second mode of operation. The operation of the tool is a function of the operation of the first and second trigger levers 10, 12, the WCE 14, the pin 16, the valve 25 and the stem 18, these components, with the pin in its first position for single cycle operation, are shown in FIGS. 1–5. A general description of the operation of those components with reference to these figures will aid in a further understanding of the invention.

Now, with reference to FIGS. 1–5, the selectable single cycle/multi-cycle pneumatic tool activation apparatus, according to the invention, operates as diagrammatically shown in these figures. The single cycle operation of this mechanism is based on the interaction of the secondary trigger lever 12, the WCE lever 14, the removable pin 16, and tool activation valve 25 and stem 18. The tool activation valve 25 is the type which must be reset after each operation to enable the tool to complete the operation cycle and return to the ready mode which will allow a subsequent operation. The tool activation valve 25 resets when stem 18 is permitted to extend out of the valve to a position close to that shown in FIG. 1. Once reset, the tool activation valve 25 will actuate the tool if stem 18 is pressed a sufficient distance upward into valve.

Figure 1:
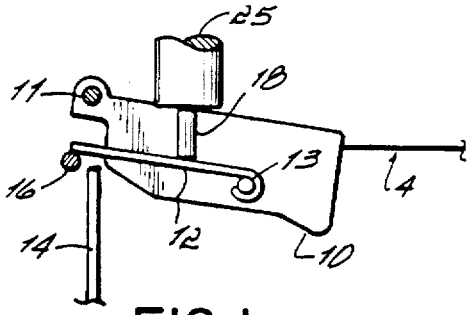
FIGS. 1, 2A, 2B, 3, 4A, 4B and 5 illustrate the various operative positions of the trigger apparatus according to the invention in one mode of operation with a mode-select pin in place according to one aspect of the invention.
Figure 2A:
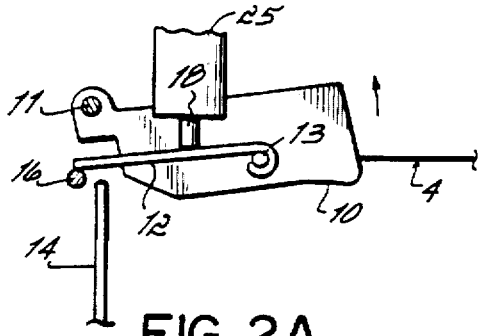
Figure 2B:
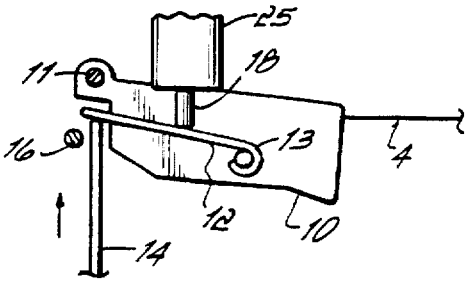

The trigger mechanism is configured so that actuating either the trigger lever 10 or the WCE lever 14 alone and without the other will not move the valve stem 18 sufficiently upward to actuate the tool. As shown in FIG. 2A, when only the trigger lever 10 is actuated, the secondary trigger lever 12, which extends between end 13 and the removable pin 16, moves the tool activation valve stem 18 upwards a short distance, but not sufficiently far to operate the valve to actuate the tool. Similarly, as shown in FIG. 2B, when only the WCE lever 14 is actuated, secondary trigger lever 12 (now extending between end 13 and WCE lever 14) moves the tool activation valve stem 18 upwards a short distance, but not sufficiently far to actuate the valve and the tool.

Figure 3:
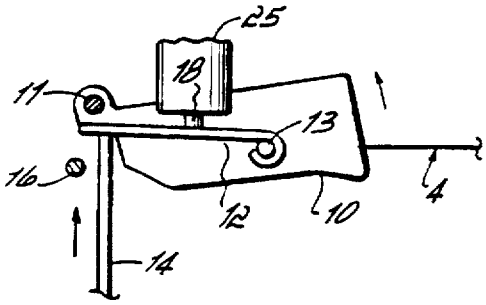

The tool will only actuate when both the lever 10 and the WCE lever 14 are actuated. As seen in FIG. 3, under these circumstances, valve stem 18 will be pressed fully into the valve 25 and the tool will actuate.

Figure 4A:
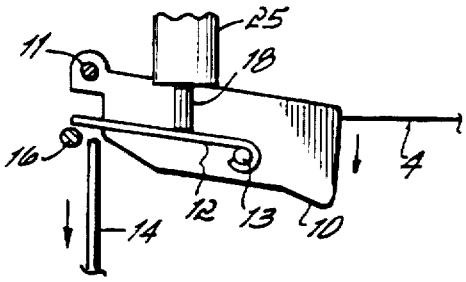
Figure 4B:
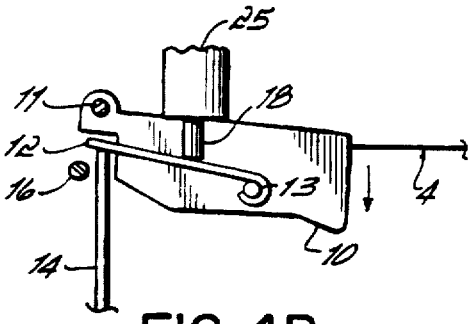

Once the tool has actuated, releasing the trigger lever 10 will reset the tool, regardless of the state of the WCE lever 14. Thus, as shown in FIGS. 4A and 4B, when the trigger lever 10 is released, the secondary trigger lever 12 allows valve stem 18 to move downward a sufficient distance to reset the tool. The valve stem 18 will move downward a sufficient distance to reset the valve regardless of whether the WCE lever 14 is released (see FIG. 4A) or is not released (see FIG. 4B).

Figure 5:
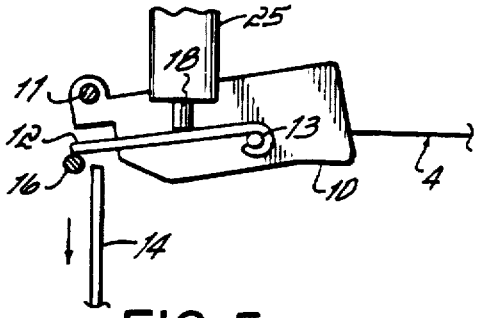

After the tool has actuated, releasing the WCE lever 14 alone will not reset the tool if the removable pin 16 is in place. As shown in FIG. 5, if the WCE lever is released after actuating the tool, without releasing the trigger lever 10, the secondary trigger lever 12 will drop onto pin 16 and cannot follow the end of the extending WCE. In this position, the secondary trigger lever 12 does not permit valve stem 18 to move downward a sufficient distance to reset the valve 25. Thus, the trigger must be released to reset the valve before the tool can be operational to drive a subsequent fastener. However, if the removable pin 16 is removed by the operator, as shown in FIG. 6, to select another operational mode, the secondary trigger lever 12, no longer constrained by the removable pin 16, will pivot further downward and will permit the valve stem 18 to move downward a sufficient distance to reset the valve.

Thus, the trigger apparatus provides two modes of operation, depending on whether the removable pin 16 is in place. When the removable pin 16 is in place, the mechanism requires that trigger lever 10 be pulled and released for every tool operation cycle. The mechanism does not, however, require that the WCE lever 14 be actuated or released for each tool operation cycle, nor does it require any sequencing of the actuation of the WCE lever 14 and trigger lever 10. When the pin 16 is in place, the tool can thus be actuated by either holding the trigger in a fully depressed condition and then pushing the tool against a work surface, or by first pushing the tool against the work surface and then fully depressing the trigger. Accordingly, the operation of the tool in the first mode of operation or the single cycle mode of operation, is not dependent on any sequential operation of the WCE with respect to the trigger 10. Nevertheless, and as noted, the tool cannot be actuated a second time unless the trigger itself is fully released and again depressed.

However, if the removable pin 16 is removed, the tool will be actuated in response to actuation of the trigger lever 10 and the WCE lever 14, in any order, and will be reset upon release of either of those components. This latter mode permits, among other things, "work contact operation" of the tool, in which the operator holds the trigger lever 10 up and actuates the tool by pushing it repeatedly onto the workpiece. Subsequent tool operations may be obtained in response to release and re-activation of either the trigger lever 10 or the WCE lever 14, again without requiring any particular sequencing.

Figure 6:
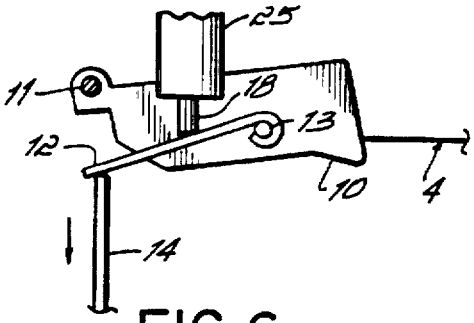
FIG. 6 illustrates an operative position of the trigger apparatus according to the invention in another mode of operation where there is no pin in place.

Having generally described the operation of the trigger apparatus, it will be appreciated from FIG. 6 that the multiple cycle or second operational mode is selected by removal of the blocking pin 16, as discussed above. Thus, as illustrated in FIG. 6, the distal end 24 of the secondary trigger lever 12 can follow the WCE 14 downwardly, unobstructed by the interference of the pin 16. This, as will be appreciated, permits the full extension of the core or stem 18 of the valve 25 so that the valve 25 can be fully reset even though the trigger 10 is held in a fully depressed condition as illustrated in FIG. 6. Thus subsequent pressings of the WCE 14 against a work surface, such as work surface 7 shown in FIG. 14, will subsequently raise the WCE 14 a sufficient distance to cause the stem 18 to move upwardly and actuate the valve 25 without requiring the trigger to be released for each cycle and without requiring any sequential operation.

In addition, it will further be appreciated from FIG. 6 that the tool can be held against a surface 7 (FIG. 14) so that the WCE 14 is maintained constantly in a depressed or upper position, opposite to that shown in FIG. 6, and the tool repeatedly functioned by repeated depressions and full releases of the trigger 10, resulting in a single cycle operation such as that illustrated in the foregoing figures where the trigger is simply released and depressed for each tool actuation when the pin is in place.

Having described the general operation of the trigger and valve apparatus to operate the tool in different modes of operation, the valve 25 will now be described in more detail and as a function of the various positions of the trigger components and the WCE, as well as the pin 16. In this regard, reference is made to FIGS. 7–13.

Referring now to FIGS. 7–13, the valve 25 shown in each of the Figures is the same valve, however, the position of various elements of the valve differs from figure to figure, as will be described.

Figure 7:
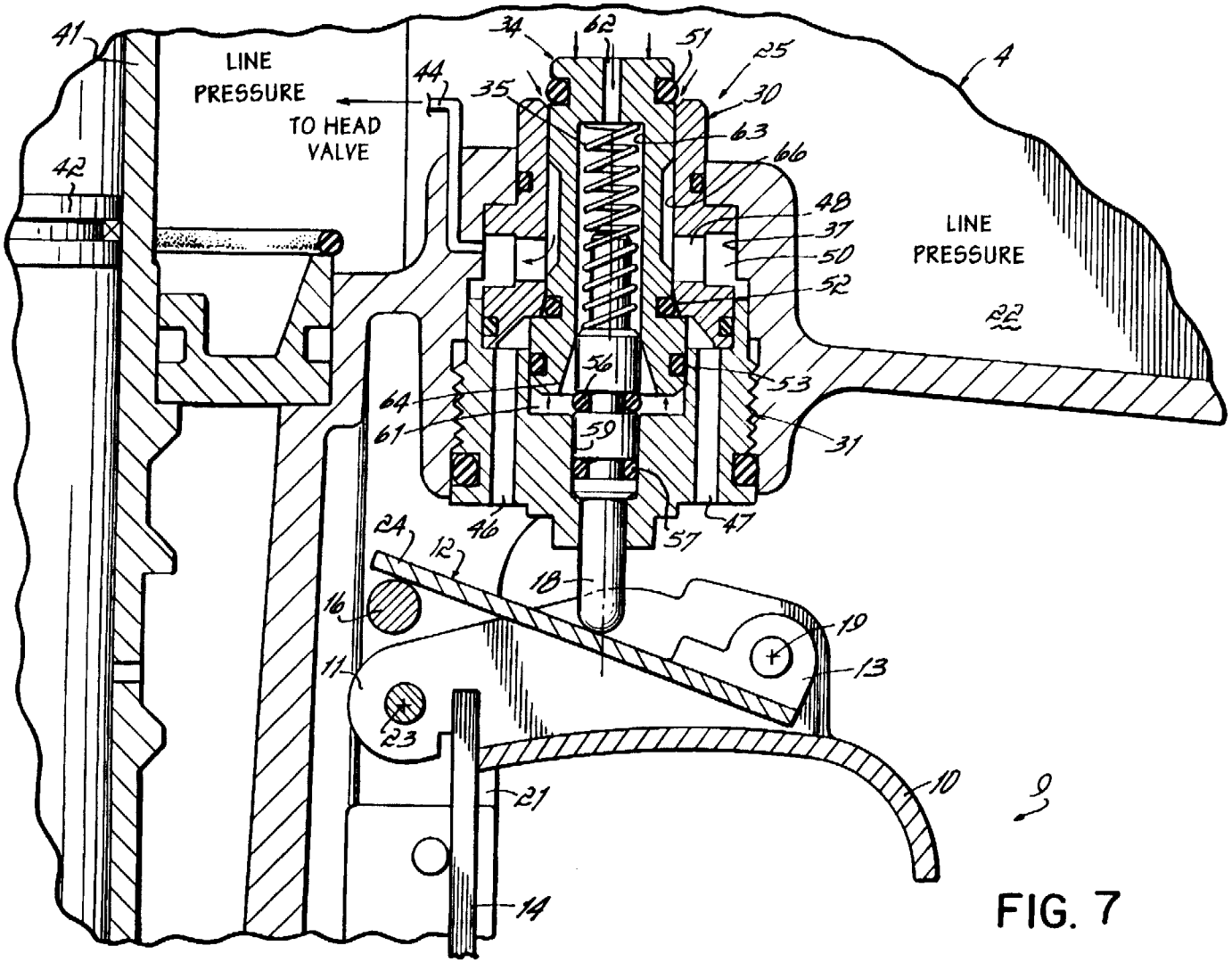
FIGS. 7–10 illustrate one mode of tool operation with a pin in place.

Accordingly, turning to FIG. 7, it will be appreciated that the valve 25 is a multiple part resettable valve comprising an upper valve body 30 and a lower valve body 31, which is externally threaded to hold the upper valve body 30 in place, in a stepped bore 37 in the tool handle 4. The valve 25 further includes a reciprocating shuttle 34 and an extensible core or stem 18 as previously discussed. A spring 35 biases the extensible core 18 downwardly, as shown in FIG. 7. The valve as shown in FIG. 7 is in a position which will be referred to as a "reset condition".

It will be appreciated that the valve 25 is located within the tool at the merger of housing 22 and handle 4 as shown in FIG. 14 and particularly within stepped bore 37 thereof, by means of the threaded lower valve body 31.

Digressing with respect to the tool itself, it will be appreciated that while the various components of the pneumatic motor or device for driving fasteners are not shown in detail, there is shown for reference in FIG. 7 portion thereof, including for example, a portion of a cylinder wall 41 and a portion of a pneumatic piston 42 connected to a driver for driving fasteners from the drive station 6 of FIG. 14. It will also be appreciated that line pressure, as indicated in FIG. 7, is available outside the cylinder wall 41 and also as indicated within the hollow handle 4 of the tool. It will also be appreciated that air passageway 44 extends from the stepped bore 37, as shown in FIG. 7, upwardly to the head valve or firing valve located above the cylinder walls 41 and the head portion 3 (FIG. 14) of the tool 1. It will also be appreciated that in a common and well known manner, when the passageway 44 is pressurized, the head valve or firing valve is held over the cylinder and the piston 42 is not activated or pushed downwardly. When, however, the air passageway 44 is vented, as will be described, the head valve or firing valve (not shown) is operable to lift off the cylinder walls 41 so that line pressure in the tool and in the tool handle can rush into the cylinder above the piston 42 and drive it downwardly to drive a fastener. Again, the so-called pneumatic motor in the firing valve or head valve, comprises no part of this particular invention.

Returning now to a description of the valve 25, it will be appreciated that the lower body 31 has a plurality of vent passages 46, 47 which may comprise, for example six in number, only two being shown in the figures. It will also be appreciated that the upper valve body 30 is provided with peripheral passages 48 communicating the interior area 49 (FIG. 8) of the upper valve body 30 with the exterior area 50 just outside the upper valve body 30 and within the stepped bore 37. Referring now to the reciprocating shuttle 34, it will be appreciated that the shuttle is provided with three external O-ring seals 51, 52, 53. Upper seal 51 is located in a groove about the upper end of the shuttle 34, but is not in contact, in the position shown in FIG. 7, with the upper valve body 30. Thus, it will be appreciated that line pressure air within the hollow handle 4 can move into the area between the shuttle 34 at its upper end, and the upper valve body 30 into the interior area 49 between the shuttle 34 and the upper valve body 30, through the passages 48 in the upper valve body 30, into the exterior areas 50 surrounding the upper valve body 30 within the stepped bore 37 and thus outwardly through the passageway 44, so as to pressurize that passageway and maintain the firing valve or head valve in an unfired condition.

With attention to the core or valve stem 18, it will be appreciated that the stem 18 is provided with upper and lower O-rings 56 and 57, respectively. The lower seal, as shown in FIG. 7, is in sealing engagement with a bore 59 (FIG. 8) within the lower valve body 31. The upper seal 56 simply rides on the core or stem 18 within the area 61 beneath the lower end of the shuttle 34. It will also be noted that the shuttle 34 includes a bore 62 at its upper end, which admits line pressure into the internal bore 63 of the shuttle 34. Thus, in the condition as shown in FIG. 7, line pressure in the hollow handle 4 is admitted through bore 62 into the bore 63 of the shuttle 34. This pressurized air moves through the bore 63 and into the tapered outlet 64 thereof, at the bottom of the shuttle. From there, the air pressurizes the area 61 beneath the shuttle 34.

From FIG. 7 it will also be appreciated that the upper area of the shuttle 34 extending within the hollow handle 4 is of less cross-sectional area than the cross-sectional area of the lower end of the shuttle 34 at the tapered bore 64. Accordingly, line pressure admitted through bore 62, 63 and tapered outlet 64 into the area 61 serve to bias the shuttle upwardly as viewed in FIG. 7. In FIG. 7, as noted, the valve 25 and tool 1 is thus in a reset position, ready for actuation.

Figure 8:
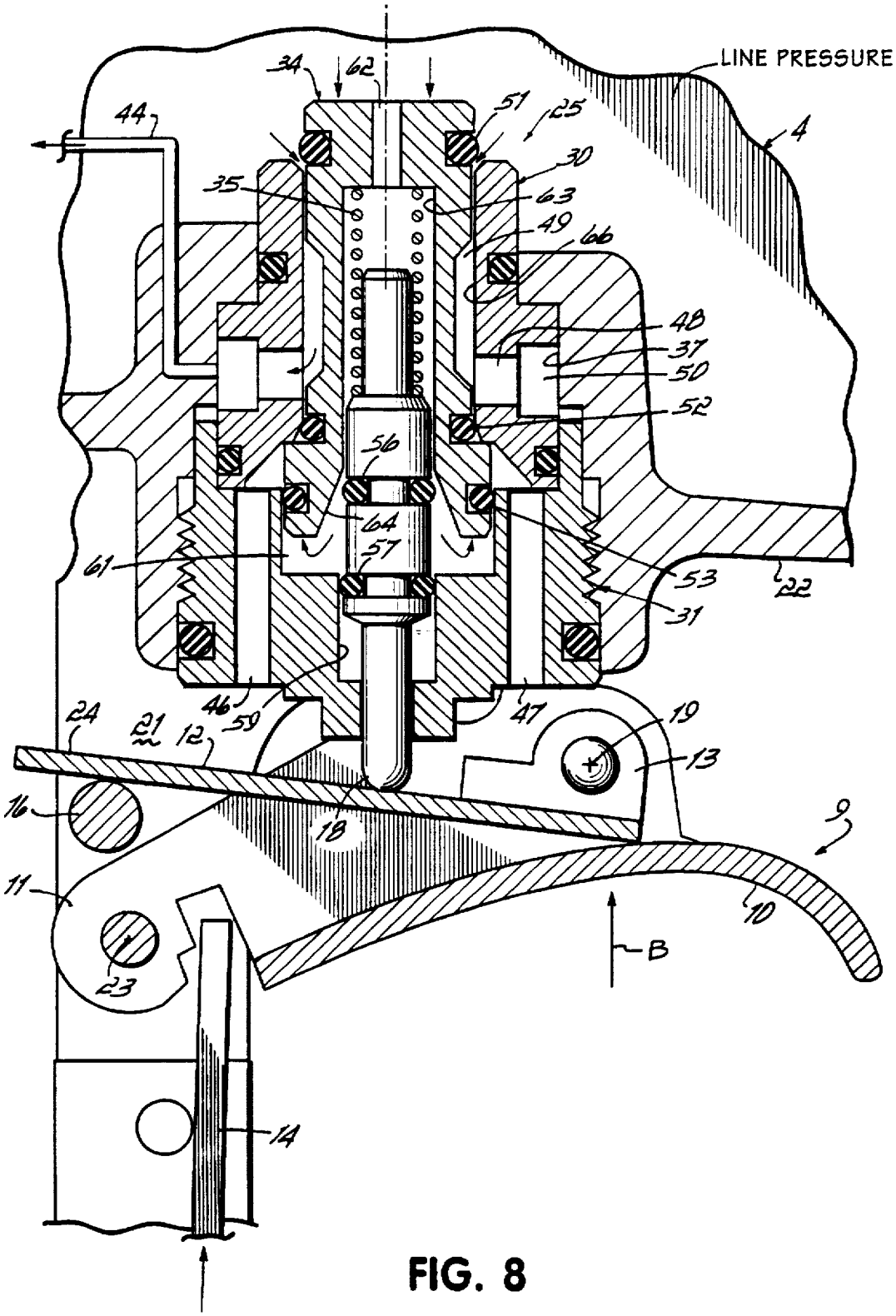

Turning now to FIG. 8, it will be appreciated that the trigger lever 10 has been fully depressed upwardly in the direction of the arrow B. This raises the rearward end 13 of the secondary lever 12, the distal end 24 thereof being supported on the pin 16. Thus the secondary lever 12 is pivoted about pin 16 to raise the stem 18 upwardly. This position corresponds to the position of the trigger and valve illustrated in FIG. 2A as described above. It will be appreciated that this upward motion of the stem 14 is not sufficient to activate the valve 25. Line pressure is still available through bores 62 and 63 to the tapered outlet 64 and the pressure area 61 beneath the shuttle 34.

Figure 9:
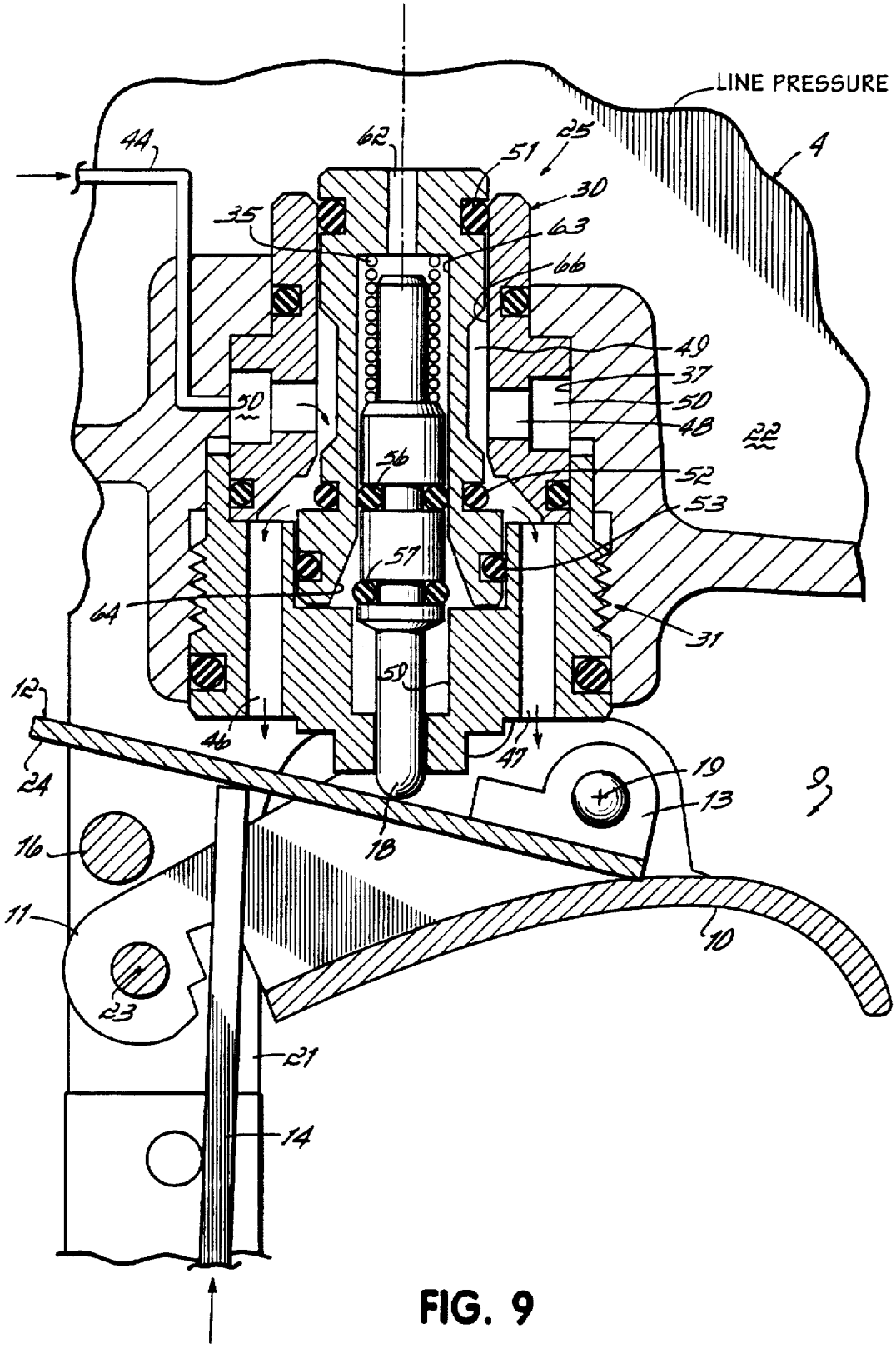

Turning now to FIG. 9, it will be appreciated that the trigger 10 has been maintained in a fully depressed condition. In addition, however, the WCE 14 has been raised by engagement of the tool toward and onto a work surface, such as work surface 7 shown in FIG. 14. In FIG. 8, of course, the WCE 14 was fully extended because the tool had not been pressed against any work surface and, even though the trigger 10 was fully depressed, the tool could not be actuated, since the motion of the trigger lever 10 and the secondary trigger lever 12, in combination, was not sufficiently far enough to push stem 18 into the valve 25 to cause the valve 25 to actuate the tool.

Nevertheless, in FIG. 9, it will be appreciated that while the trigger 10 has remained depressed, the tool has now been pressed onto a work surface and the WCE 14 depressed, so as to lift the end 24 of the secondary lever 12 off the pin 16 and upwardly. This further motion of the lever 12 about pivot point 19 moves the stem 18 further upwardly so that, as will be appreciated, the upper seal 56 has now engaged in sealing condition the internal bore 63. Also, it will be appreciated that the lower seal 57 on the stem 18 has cleared sealing engagement with the bore 59 in the lower valve body 31.

As a result, the air passageway 44 is vented, as will be described. In particular, since the upper seal 56 has engaged the bore 63, line pressure is no longer available through the tapered outlet 64. Since the lower seal 57 has now cleared the bore 59, pressurized air in the area 61 is vented downwardly around the valve stem 18 and outwardly of the tool. This relieves pressure on the bottom of the shuttle 34, so that pressure acting on top of the shuttle pushes the shuttle downwardly into the upper valve body 30 and into the lower valve body 31.

At the same time, the seal 52 around the shuttle 34 clears the bore 66 in the upper valve body 30, so that there is no seal between the shuttle and the upper valve body below the interior area 49. Accordingly, pressurized air in the air passageway 44 can be vented through the passageway 44, the exterior area 50, the passages 48 and downwardly through the vent bores 46 and 47, as illustrated by the flow arrows in FIG. 9. This vents the passage 44 in the head or firing valve to actuate the tool.

Figure 10:
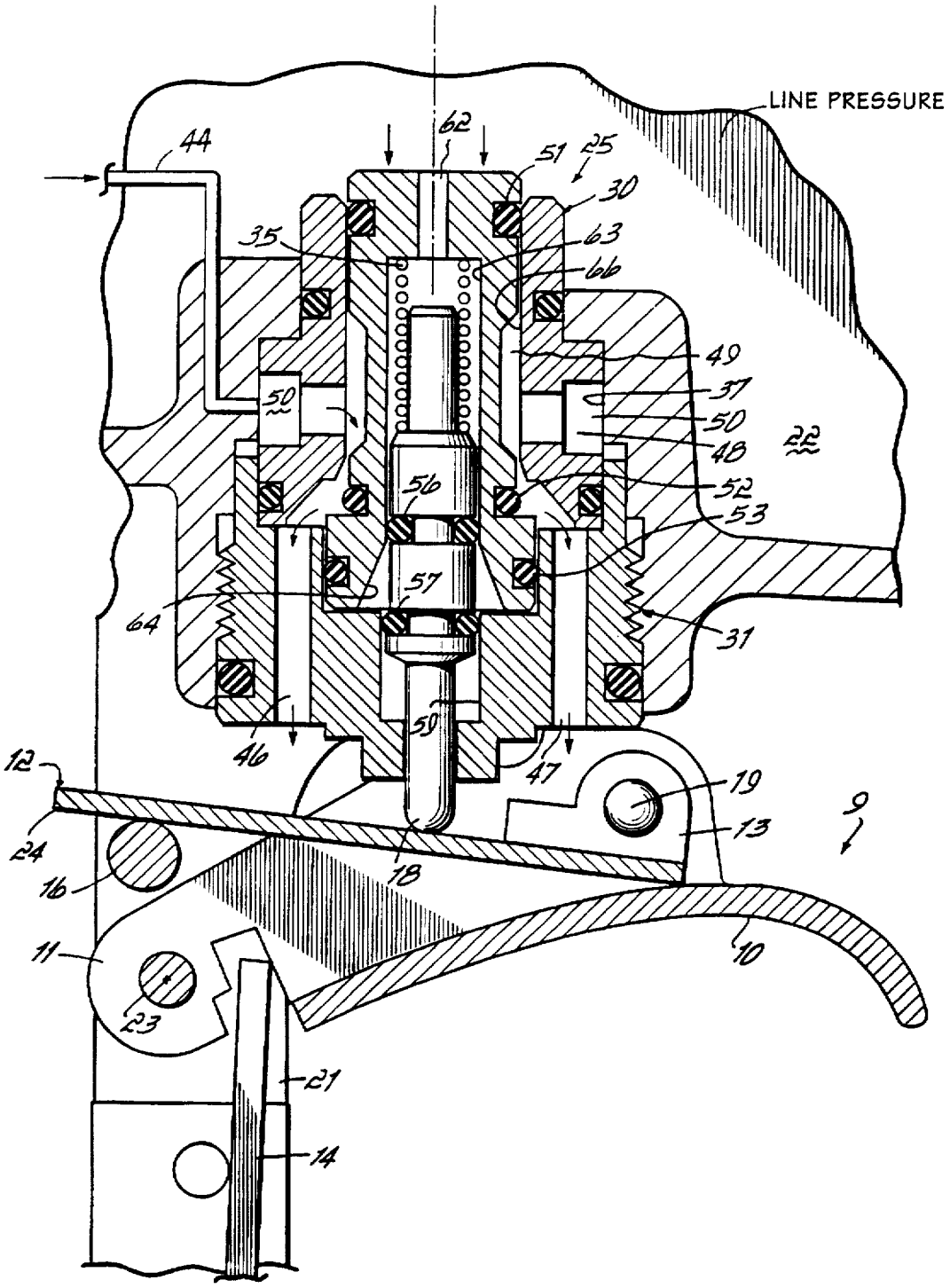

Turning now to FIG. 10, it will be appreciated that the WCE 14 has now been extended since, after the actuation of the tool as illustrated in FIG. 9, the tool has been lifted away from a work surface. In this position, where the trigger parts and stem are in the same positions as in FIG. 8, the secondary lever 12 is supported on the pin 16 and the trigger 10 is still in depressed condition. Nevertheless, it will be appreciated that the shuttle 34 has moved downwardly by the activation of the valve. Seal 56 is still in sealing relation with the bore 63, thus preventing line pressure from entering through the bore 62 into the area below the shuttle 34. Thus, the shuttle 34 is still in its downward-most condition and the valve has not yet been reset, despite the fact that the WCE 14 has been withdrawn, and despite the fact that seal 57 may now be sealing against bore 59. As noted, this position is caused by the retention or blocking function of the mode selecting pin 16 with respect to the lever 12, thus blocking the lever 12 from further downward motion and preventing the downward motion of the stem 18 sufficiently to cause seal 56 to unseat from bore 63 and the valve 25 to be reset. Accordingly, the passageway 44 is still being vented past the descended shuttle 34, as illustrated by the flow arrows in FIG. 10. And since the valve 25 has not been reset, any further activation or depression of the WCE 14 will not operate to activate the valve, even though the stem 18 is again moved slightly upwardly by full depression of the WCE 14.

Thus, it will be appreciated that the only way the valve can be reset in this mode of operation, is by release of the trigger lever 10, which will permit the lever 12 to further pivot about the pin 16 and move downwardly, thereby allowing the stem or core 18 to move downwardly, and breaking the seal between the seal 56 against the bore 63 in the shuttle 34. When seal 56 clears bore 63, line pressure air flows beneath the shuttle 34 into area 61 and raises the shuttle, then resetting the valve 25 for another operation, i.e. with the valve in position as shown in FIG. 7.

Accordingly, when the blocking element or pin 16 is in place, it will be appreciated that the tool can only be actuated in a single cycle; that is, it requires a full release and a pull of the trigger 10 in order to reset the tool and then actuate the tool a second time once the tool is again urged against a workpiece to depress the WCE 14. Merely lifting the tool away from the work surface and depressing it so that the WCE 14 reciprocates is not sufficient to reset the valve 25 and cause it to actuate the tool again, unless the trigger is also fully released in the interim.

Returning now to FIGS. 11 and 12, operation of the tool in the second or multiple cycle mode, with pin 16 removed, will be described. Here, it will be appreciated that the blocking element or pin 16 has been removed. Therefore, there is no pin or blocking element to restrict the movement of the end 24 of the secondary lever 12. Thus, for example, with reference to FIG. 11, it will be appreciated that the tool has been pressed against a workpiece so that the WCE 14 has been depressed or fully lifted against the far end of the lever 12, pivoting it upwardly. As will be appreciated in FIG. 11, however, the trigger 10 has not been depressed and the full motion of the WCE 14 is not sufficient to move the stem 18 upwardly enough to actuate the valve 25. Thus, the tool remains in a ready-to-be-actuated condition.

Figure 12:
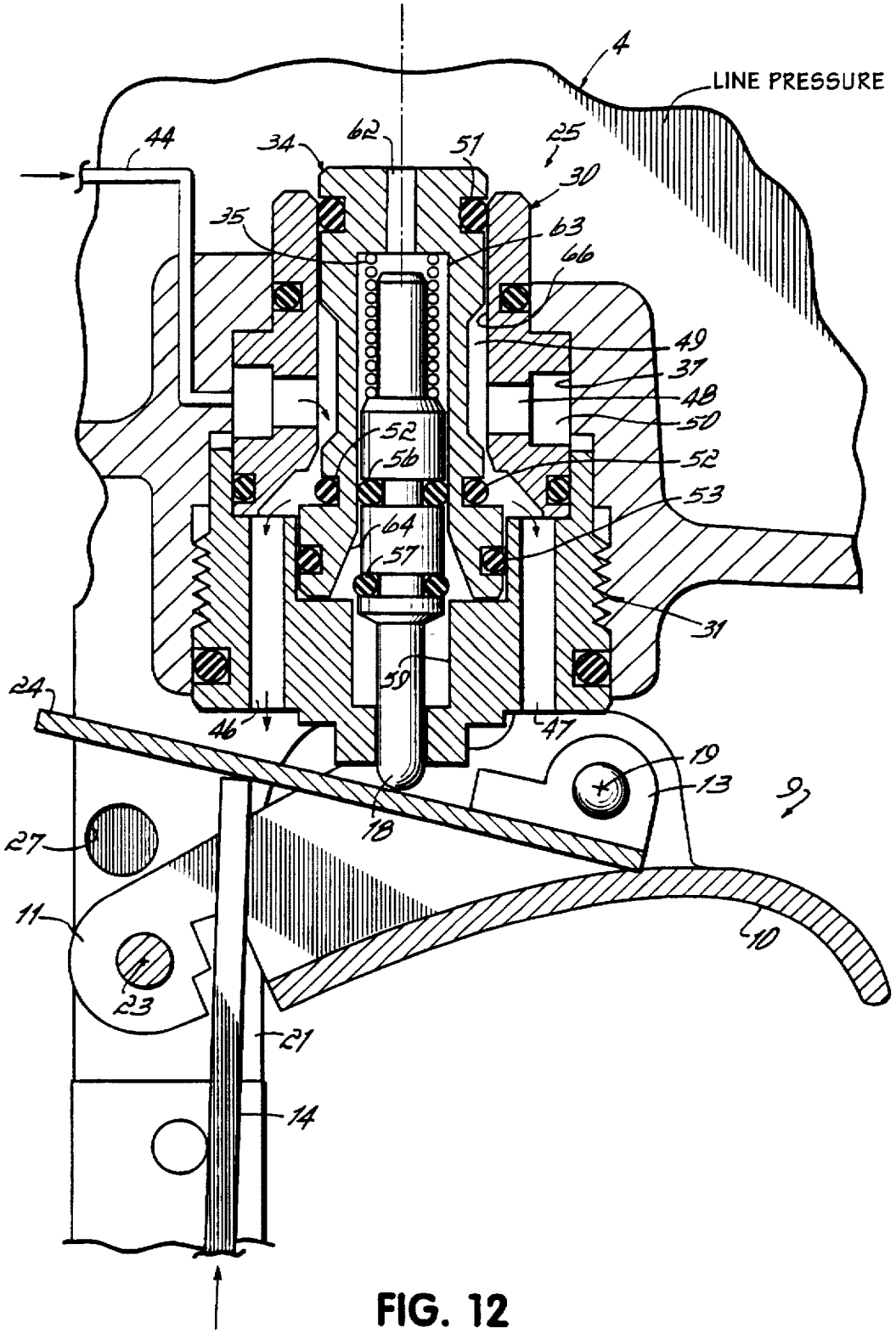

When the trigger 10 is depressed, it will be appreciated that the pivot axis 19 is raised, while the other end 24 of the lever 12 is maintained in position and pivots about the upper end of the WCE 14. This is sufficient to raise the core 18 to activate the tool, such as illustrated in FIG. 12. In FIG. 12, the valve is in the actuated condition, such as illustrated in FIG. 9, with the secondary lever moved upwardly against the stem 18 by virtue of its riding on the upper end of the depressed WCE 14 and by virtue of its movement upwardly by depression of the first trigger lever 10 about axis 23. In this condition, the shuttle 34 has moved downwardly to vent the passage 44 and cause the tool to actuate.

Figure 11:
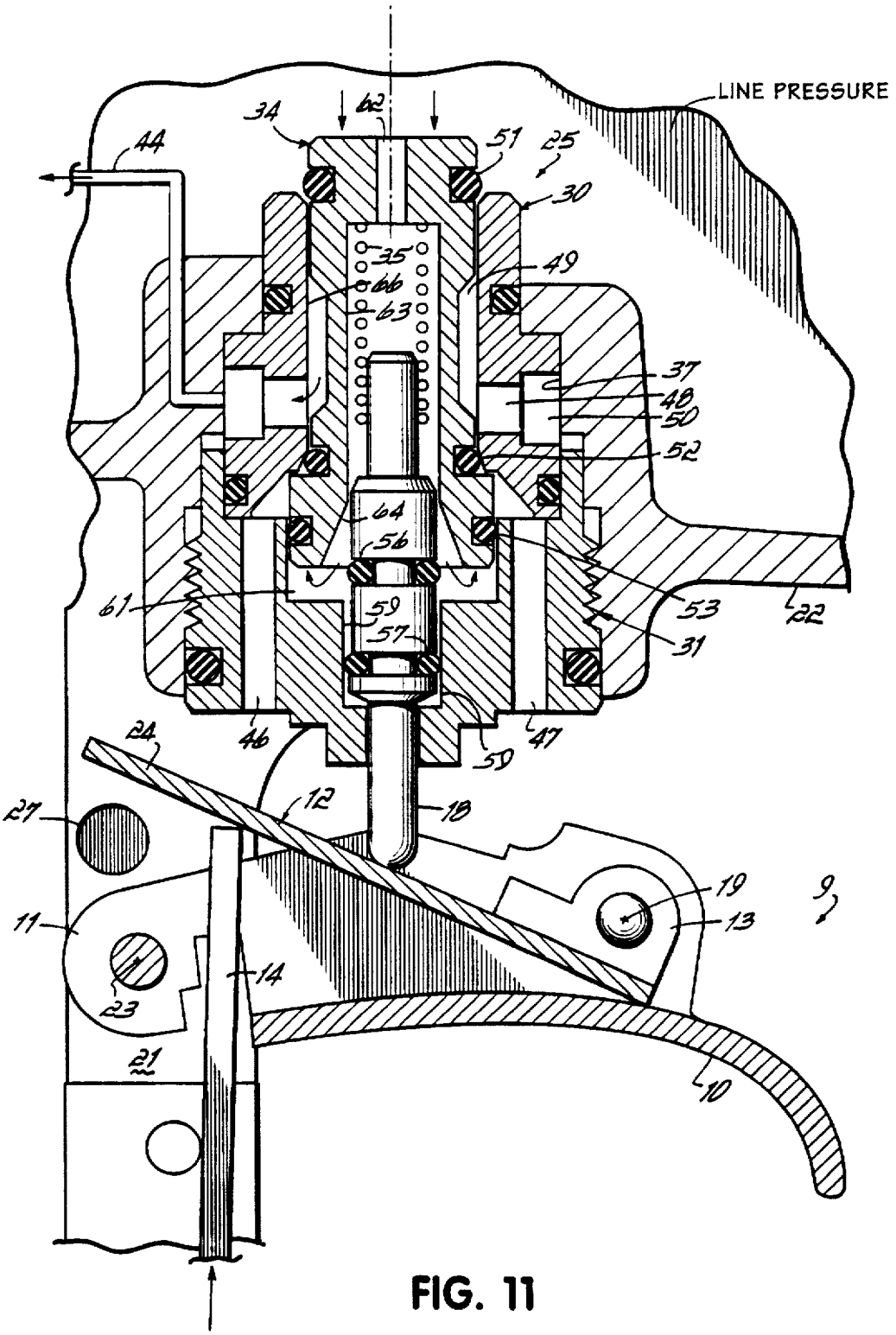
FIGS. 11–13 illustrate another mode of operation with no pin in place.

There is, however, a striking difference between this mode of operation and that previously described in the figures preceding FIG. 11. It will be appreciated that the trigger 10 can be maintained in the depressed condition as shown in FIG. 12, yet when the tool is moved away from a work surface, the WCE 14 can be lowered corresponding to the position such as shown in FIG. 6, for example. The pin 16 is absent and nothing blocks end 24 of lever 12. That lowering is sufficient to allow the stem 18 to move downwardly out of the valve 25 sufficiently to reset the valve. Thereafter the tool can be reactuated merely by pressing it against a work surface, the WCE moving upwardly to raise lever 12, and therefore the tool actuated in a "bottom contact" operational mode.

It will also be appreciated from reviewing FIGS. 11 and 12 that the end 24 of the lever 12 is not restricted by any pin extending through the bores 27 and the flanges 20, 21 for example. Accordingly, the end 24 of the lever 12 is able to move through a greater or wider range or angle of motion to permit the full reset motion of the stem 18 and the full activation by the operation of the WCE 14 for so long as the trigger 10 is depressed.

In addition, it will also be appreciated, however, that if the trigger 10 is released and the tool pressed against a work surface, such as the condition shown in FIG. 11, the tool will not actuate, since lever 12 has not been raised sufficiently to move stem 18 up into the valve 25. Nevertheless, on further depression of the trigger 10, such as shown in FIG. 12, the tool can be activated to drive a fastener. Thereafter, the tool must either be withdrawn from the work surface or the trigger must be released and re-depressed in order to activate the tool to drive a subsequent fastener.

Figure 13:
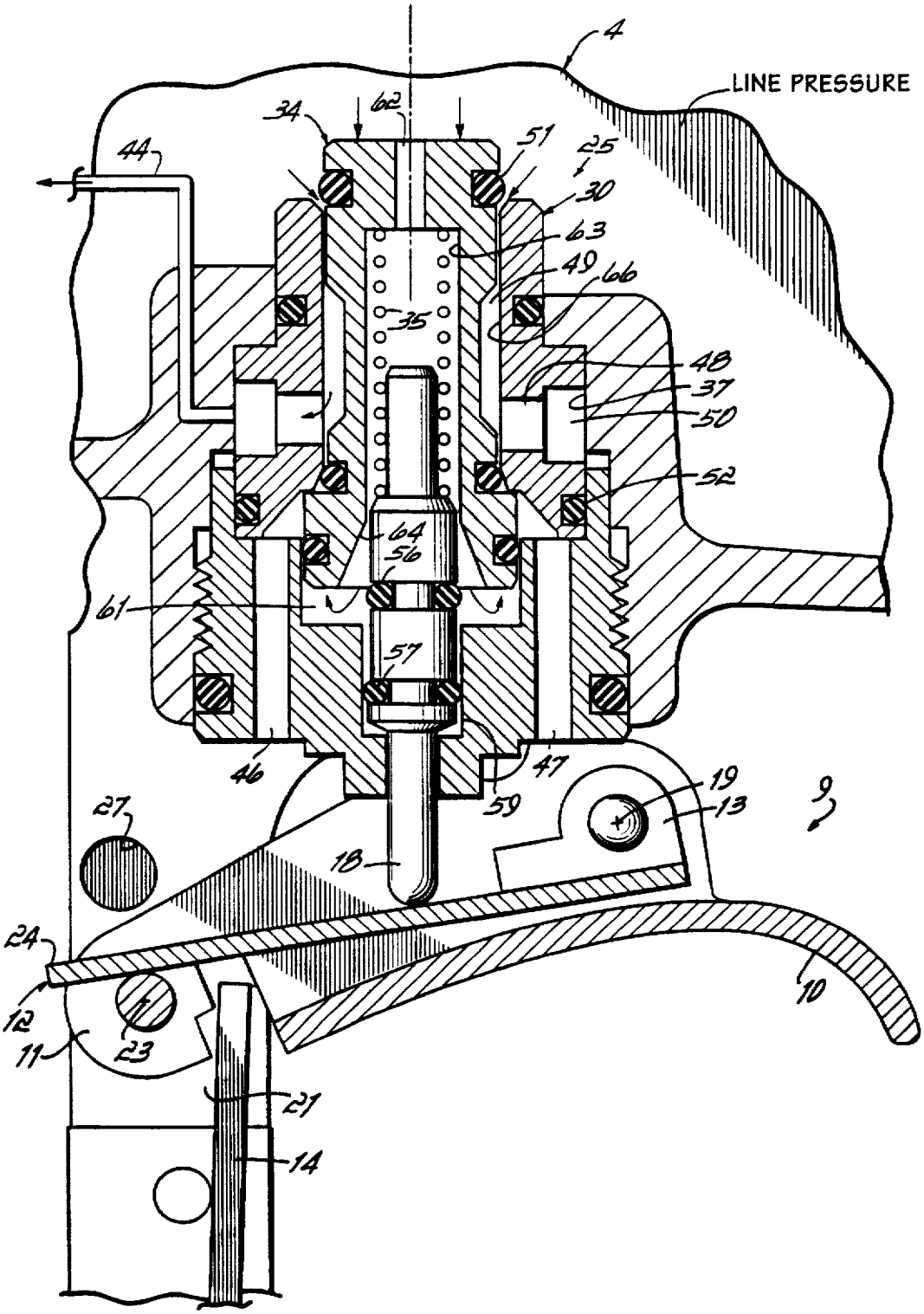

FIG. 13 illustrates the condition where there is no pin in the bore 27 and the end 24 of the lever 12 has followed the WCE 14 downwardly a distance sufficient to allow the stem 18 to move outwardly of the valve 25 in order to reset the valve 25. Here, as illustrated in FIG. 13, the seal 57 has re-engaged the bore 59 to shut off any venting of the area 61 beneath the shuttle 34. Seal 56 has moved out of bore 63. This permits line pressure through the bore 62 in the upper end of the shuttle and in bore 63 to pressurize the area 61 and again raise the shuttle 34 to a reset condition. In this condition, the seal 51 has cleared the upper end of the upper housing 30 so that line pressure again moves between the upper housing and the shuttle and into the passageway 44, so that the tool is pressurized and ready for the next actuation.

Accordingly, the invention provides a dual operational mode in a pneumatic fastener driving tool 1. The tool 1 may be operated in a single cycle mode requiring full depression and release of the trigger 10 for each subsequent actuation of the tool to drive the fastener. In a second mode, a trigger blocking pin 16 is removed and the tool can be repeatedly actuated by maintaining the trigger 10 in a depressed condition and simply pressing the tool against a surface for actuating the tool, withdrawing the tool and again pressing it against a surface for actuating the tool again. Alternately, the tool in the second mode can be held against a work surface and actuated repeatedly by depressing and releasing the first trigger lever 10, the valve resetting between each of these operations.

These and other objectives and advantages will become even more readily apparent from the following detailed description of a preferred embodiment and from the drawings in which:

We claim:

1. A resettable valve and trigger apparatus for use in a dual mode pneumatic tool for driving fasteners, said valve and trigger apparatus including:

a valve body;

a reciprocable shuttle mounted in said body;

an extensible stem in said shuttle and valve body;

said stem being depressible to release pressure holding said shuttle in one position, said shuttle moving to an actuate position to vent said tool to actuate said tool to drive a fastener;

said stem being extensible to admit pressure acting on said shuttle to return said shuttle to a reset position to pressurize said tool to a ready state for subsequent actuation;

said valve being inoperable between actuations unless said shuttle is moved between actuated and reset positions; and a trigger apparatus for controlling the extension and depression of said stem as a function of the condition of said tool with respect to a work surface and as a function of the presence or absence of a mode selecting blocking member.

2. A method of operating a pneumatically operated fastener driving tool in first and second modes of operation, the second mode including both a first mode and another mode, the method including the steps of:

operating the tool in a first mode by urging it against a work surface and depressing a trigger to drive a fastener, releasing the trigger to reset a trigger valve and then depressing the trigger to actuate the tool to drive another fastener whether or not the tool has been removed from the work surface, the tool not being operable to drive a fastener unless the trigger is fully cycled; and operating the tool in a second mode including the steps of:

removing a blocking element from operative trigger blocking position it resided in during said first mode of operation and thereafter operating said tool in said first mode and then repeatedly in another mode by holding said trigger and pressing said tool against a work surface without releasing said trigger.

* * * * *